US009012822B2

(12) United States Patent
Yu

(10) Patent No.: US 9,012,822 B2
(45) Date of Patent: Apr. 21, 2015

(54) MISSILE GUIDANCE

(75) Inventor: Wai Yu, Belfast (GB)

(73) Assignee: Thales Holdings UK Plc, Weybridge (GB)

( * ) Notice: Subject to any disclaimer, the term of this patent is extended or adjusted under 35 U.S.C. 154(b) by 202 days.

(21) Appl. No.: 13/552,038

(22) Filed: Jul. 18, 2012

(65) Prior Publication Data

US 2014/0138473 A1 May 22, 2014

(51) Int. Cl.
*F41G 7/26* (2006.01)
*F41G 7/00* (2006.01)

(52) U.S. Cl.
CPC ..... *F41G 7/263* (2013.01)

(58) Field of Classification Search
CPC ..... F41G 7/20; F41G 7/22; F41G 7/2246; F41G 7/24; F41G 7/26; F41G 7/263
USPC ..... 244/3.1–3.3; 701/1–4; 250/200, 216, 250/221, 222.1, 222.2, 224; 356/3, 20, 21, 356/22, 27, 28, 28.5, 138, 140, 141.1–141.5
See application file for complete search history.

(56) References Cited

U.S. PATENT DOCUMENTS

| | | | | | |
|---|---|---|---|---|---|
| 4,047,816 | A | * | 9/1977 | Pell et al. | 356/141.1 |
| 4,111,383 | A | * | 9/1978 | Allen et al. | 244/3.13 |
| 4,111,384 | A | * | 9/1978 | Cooper | 244/3.13 |
| 4,111,385 | A | * | 9/1978 | Allen | 244/3.13 |
| 4,174,818 | A | | 11/1979 | Glenn | |
| 4,186,899 | A | * | 2/1980 | Stewart, Jr. | 244/3.13 |
| 4,229,103 | A | * | 10/1980 | Hipp | 356/141.1 |
| 4,324,977 | A | * | 4/1982 | Brauer | 250/222.2 |
| 4,406,430 | A | * | 9/1983 | Krammer et al. | 244/3.13 |
| 4,709,875 | A | * | 12/1987 | Cremosnik et al. | 244/3.13 |
| 5,056,736 | A | | 10/1991 | Barton | |
| 5,427,328 | A | * | 6/1995 | Tong et al. | 244/3.13 |
| 5,533,692 | A | * | 7/1996 | Layton | 244/3.13 |
| 5,647,559 | A | * | 7/1997 | Romer et al. | 244/3.13 |
| 6,357,694 | B1 | * | 3/2002 | Adda | 244/3.13 |
| 6,396,577 | B1 | * | 5/2002 | Ramstack | 356/141.1 |
| 7,175,130 | B2 | * | 2/2007 | Dubois et al. | 244/3.13 |
| 7,944,549 | B2 | * | 5/2011 | Oron et al. | 356/28 |
| 8,386,096 | B2 | * | 2/2013 | Stimac et al. | 356/22 |

FOREIGN PATENT DOCUMENTS

| | | |
|---|---|---|
| GB | 1 517 794 | 7/1978 |
| GB | 2 345 952 A | 7/2000 |
| RU | 2 382 315 C1 | 2/2010 |
| RU | 2 421 680 C2 | 6/2011 |

OTHER PUBLICATIONS

Search Report issued Nov. 29, 2011 in United Kingdom Patent Application No. 1109543.7.
European Search Report Issued Nov. 23, 2012, in Patent Application No. EP 12 17 6984.

* cited by examiner

*Primary Examiner* — Bernarr Gregory
(74) *Attorney, Agent, or Firm* — Oblon, McClelland, Maier & Neustadt, L.L.P.

(57) ABSTRACT

Missile guidance involving projection of laser light to define a Laser Information Field (LIF) is augmented by interposition of information pulses, interleaved between laser emissions establishing the LIF. Information pulses encode further information for receipt by a missile, such as an angle of roll of a missile launch platform from which the LIF is emitted.

14 Claims, 6 Drawing Sheets

MISSILE GUIDANCE

The present invention relates to missile guidance, and particularly to laser assisted missile guidance.

Missile guidance using lasers has been known for some considerable time. For example, UK Patent 1517794 discloses the general principle that laser missile guidance can be implemented.

A laser beam riding missile guidance system typically comprises a guidance laser operable to generate an intermittently projected laser beam which is directed to form a Laser Information Field (LIF). In general terms, a LIF is a divergent projection of a laser beam, describing a volume which is, in cross section relative to the direction of projection, substantially rectangular. The LIF is formed by scanning and sweeping a laser beam across (azimuth) and down (elevation) with respect to a general projection direction.

By modulating an information signal bearing positional data on to the laser beam forming the LIF, a missile with a suitable detector in its rear face can determine its position relative the bounds of the LIF, from the received positional data. If the missile has suitable guidance mechanisms, it can alter its trajectory to maintain a particular position relative the LIF, or use the LIF as a means of steering towards a target. In one example, the positional data is used by a missile to detect the displacement of its trajectory from a centre line of the LIF (in the beam projection direction) and to make suitable adjustments to its flight control in order to bring itself to the centre of the LIF. The reader will appreciate that standard control techniques can be used to achieve this, and such is beyond the scope of this disclosure.

A problem with existing implementations is that there is no continuing communications link from a launch platform to a missile, once a missile has been launched from its canister. Missile parameters, such as the fuse setting of the missile (i.e. when the operator of the missile desires an explosive element of the missile to activate), have to be set before firing and cannot be changed thereafter.

The LIF as described above also only provides a static positional reference frame, as it is essentially merely a two dimensional grid of laser pulses. A missile fired in such a reference frame calculates its azimuth and elevation displacement (i.e. its pitch and yaw), with regard to the LIF, by detecting spacing between laser pulses defining grid lines in the LIF.

Existing implementations, such as that described above, have no facility to enable a missile to detect roll of the launch platform from which the LIF is projected, and thus the orientation of the LIF itself. Thus, the extent to which a positional decoding is correct depends on the launch platform remaining substantially horizontal with respect to the ground. If the launch platform is subject to roll, then this will distort the reference frame provided by the LIF.

In a system such as described above, including a launch platform not mounted on the ground, and so is subject to roll, then means for stabilising this roll is often provided. This is evident in the case of a launch platform on a ship. This can be a mechanical roll stabilisation device. It may also be possible to include roll stabilisation in a large aircraft.

However, on smaller installations, such as on a helicopter or an unmanned airborne vehicle (UAV), roll stabilisation can be difficult to achieve. This is due to the size and weight of roll stabilisation devices, and the capacity of a smaller vehicle to accommodate large mechanical devices of such nature. Further, in such installations, there may be severe constraints on the mass and size of supplied additional equipment, both in terms of space and also payload.

Moreover, the capability of any roll stabilisation device to eliminate the effect of roll on a LIF generator will inevitably be limited. This applies to the range of rotational displacement (roll) which might arise, or the rate of change of roll of such a launch platform. This can be such that the range and rate of change of roll can exceed the capability of a practical roll stabilisation device, particularly if the launch platform is itself relatively small (and thus more susceptible to external atmospheric and hydrostatic forces) and maneuverable.

Accordingly, rather than rely on the ability of a launch platform to stabilise roll, or to compensate for it, an aspect of the invention provides an approach which involves detecting roll, and conveying information describing detected roll to a missile during flight. This is done using a system which otherwise would be used for guidance of the missile.

An aspect of the invention involves implementation of a laser based missile guidance system which does not rely on moving a guidance laser beam to compensate for roll, but rather to project, to an intended recipient, information to enable the recipient projectile to compensate for roll at the launch platform, and thus to counter the effect of roll on the guidance laser beam.

An aspect of the invention provides a missile launch platform operable to establish wireless communication with a missile launched therefrom, the platform comprising roll measurement means operable to determine roll of said platform with respect to a reference frame, and roll information communication means operable to emit a signal towards a launched missile, the signal bearing roll information describing roll of said platform relative to said reference frame.

The roll information may comprise roll angle information. The roll measurement means may comprise a sensor on the launch platform operable to measure roll angle. The roll measurement means may comprise roll information encoding means operable to encode roll information prior to emission. The roll information encoding means may be operable to encode roll information into a piece of digital information. In one embodiment, a piece of digital information comprises a binary code. The binary code may comprise a six bit binary word.

The roll information may be linearly quantised into the binary information.

The launch platform may comprise laser emission means operable to emit a laser beam suitable for bearing information, the laser beam being suitable for detection by a launched missile. The laser emission means may be operable to emit one or more positional laser pulse trains intended to impart positional information to a launched missile on which said laser beam is incident. The launch platform may be configured to impose said signal bearing roll information on said laser beam.

Another aspect of the invention comprises a missile comprising a laser beam detector operable to detect a laser beam incident thereon and to resolve an information bearing signal therefrom, a signal processor operable to extract, from a received signal, position information and roll information, and a missile flight controller operable in accordance with extracted position information and roll information to control flight of said missile.

Further aspects, features and advantages of the invention will become apparent from the following description of a particular embodiment thereof, with reference to the accompanying drawings, in which.

Figure 1:
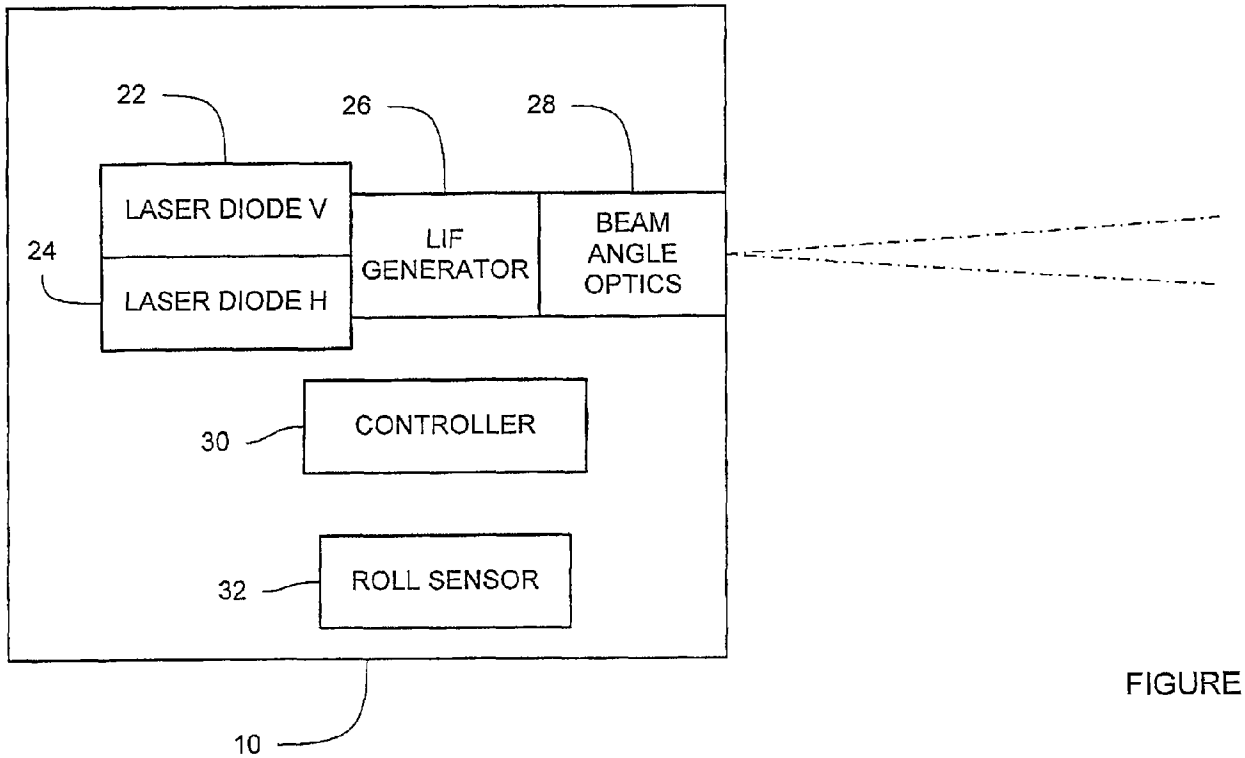
FIG. 1 is a schematic diagram of a missile guidance beam generator in accordance with an embodiment of the invention.

Referring to FIG. 1, a missile guidance beam generator 10 is shown schematically in FIG. 1, but the reader will understand that it will comprise an outer casing suitably adapted to be affixed to a barrel of a launcher, by conventional means.

The generator 10 is operable to generate a Laser Information Field (LIF). While the structure by which this is delivered will be described in due course, the reader will benefit from a functional description also.

As a missile is primed for launch, its guidance circuitry is synchronised with the beam generation apparatus 10. The LIF is projected by the generator 10, such that a receiver of the missile synchronises with the LIF. Through this, the missile can gather information about its position relative to the intended trajectory defined by the projected LIF, and make any adjustments to its flight control apparatus that might be required in order to maintain that trajectory.

The manner in which this is implemented in accordance with the specific embodiment will now be described with reference to FIG. 1. The generator 10 comprises two laser diodes 22, 24 each assigned to generation of laser light in response to control signals from a controller 30. In use, the missile guidance beam generator 10 will be affixed to a barrel of a launcher of a missile adapted to receive laser light projected from the generator 10, or to a land platform. A roll sensor 32 provides a signal to the controller 30, for the insertion of roll information into the stream of pulses generated by the laser diodes 22, 24 as will be described in due course.

Figure 2:
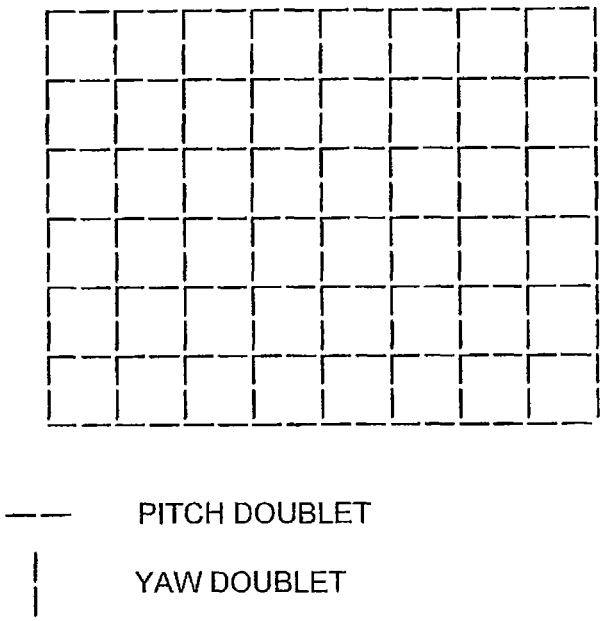
FIG. 2 is a schematic cross section of a laser guidance beam emitted by the generator of FIG. 1, over a period of one sweep from top to bottom for a laser diode V and from left to right for a laser diode H.

Each laser diode 22, 24 is configured to correspond to lines of a LIF, such as that illustrated in FIG. 2, extending in one direction. Thus, the laser diode 22 is denoted "laser diode H" (horizontal) and laser diode 24 is denoted "laser diode V" (vertical) in FIG. 1. Laser diode 22 is responsible for the generation of the horizontal lines of the LIF, and laser diode 24 is responsible for the generation of the vertical lines of the LIF.

Each line of the LIF is created by the scanning action of a LIF generator 26. This takes, as an input, pulses of light generated by the laser diodes 22, 24. It scans this light across the field of projection intended to be imparted with the LIF and then passes the scanned light to beam angle optics 28 for conditioning of the beam of light for output.

The light generated by each diode is emitted in the form of pulses. For signalling reasons, light is emitted, by each diode, in sequences of two pulses. Each combination of two pulses is known as a doublet. The doublets are spaced in time, by a predetermined delay, so that a receiver, furnished with information as to the delays used, can detect the presence of a doublet and thus the presence of light of the LIF. From knowledge of the expected arrangement of doublets across a scanned LIF, a missile in receipt of light from the generator 10 can determine its position relative to an intended trajectory and make any necessary adjustments to its flight path. Accordingly, the LIF can be thought of as being the projection, across time and space, of pulses encoding positional information, from which a suitably configured receiver can determine its position relative to the path defined by the LIF.

Figure 3:
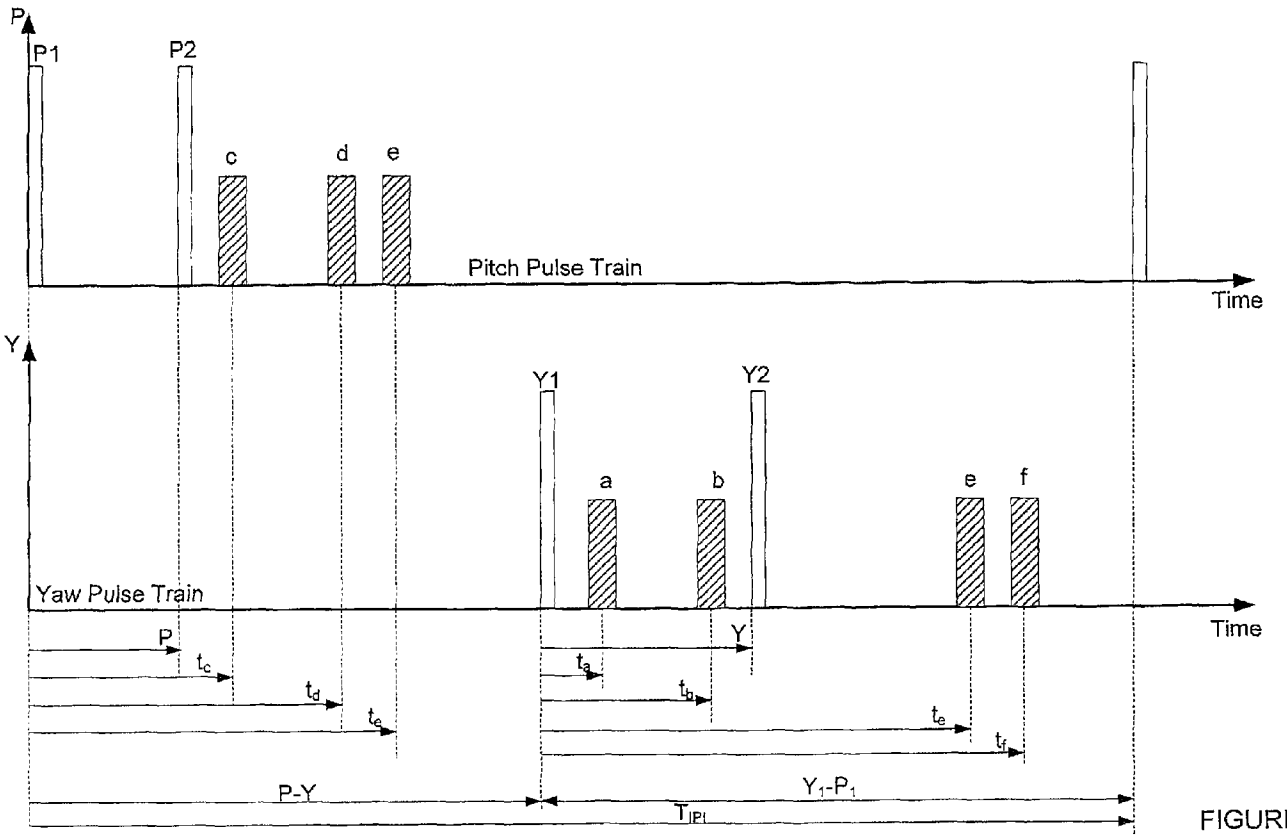
FIG. 3 is a timing diagram of pulses emitted by the generator in pursuit of emission of the laser guidance beam of FIG. 2, in an example in the field of the embodiment of the invention.

FIG. 3 illustrates an example emission of light pulses by the generator 10, over time. This arrangement is conventional, and exemplary of the field of the invention, but not part of the invention per se.

In the upper line, pulses of light emanating from the laser diode 22, governing pitch of the missile, are illustrated. In the lower line, a pulse train from the laser diode 24 is illustrated, from which a suitable receiver can determine yaw from an ideal trajectory.

A pitch doublet is indicated in the upper line, denoted pulses P1 and P2. The doublet is emitted periodically, with a period $T_{IPI}$. The time between P1 and P2 is also predetermined, denoted P in FIG. 3. The pitch doublet is validated by pitch validity detection windows c, d, e, at times $t_c$, $t_d$, and $t_e$ after the first pitch doublet pulse P1. A receiver, intended to detect the presence of a pitch doublet, will validate a pitch doublet by the absence of pulses to these windows. Times $t_c$, $t_d$, and $t_e$ are predetermined, and known to the receiver. Presence of pulses at these times will cause the receiver to reject detected pulses as instances of pulses P1 and P2.

Assuming that pulses c, d and e are not detected, P1 and P2 are detected. The spacing in time between P1 and P2 and the following pair of P1 and P2 ($T_{IPI}$) is encoded, and defines the position of the receiver in the pitch direction. Spacing between the two pairs of pulses varies with pitch.

The receiver synchronises to the time of receipt of P1. A predetermined time (P−Y) after transmission of P1, the laser diode 24 dedicated to emission of yaw doublets is energised, and issues a pair of pulses Y1 and Y2, spaced apart by a time Y which varies in the yaw direction swept across the LIF. By this, the receiver can detect its yaw. The yaw pulses Y1, Y2 are validated by the determination that no pulses are detected in yaw validation windows a, b, e, f, at respective times $t_a$, $t_b$, $t_e$ and $t_f$ after the emission of pulse Y1. It should be noted that the use of the notation $t_e$ to describe the position of yaw validation window e does not imply that yaw validation window e is positioned at the same time lapse after lead pulse Y1 as the spacing of pitch validation pulse e after P1.

The pitch and yaw pulses, are positioned so as to limit the possibility of the laser diodes being overheated, or otherwise being subject to deleterious consequences as a result of overuse. They are also positioned so as to provide, as far as possible, uniquely identifiable time periods between pulses, so that pulses can be distinguished by the receiver.

Figure 4:
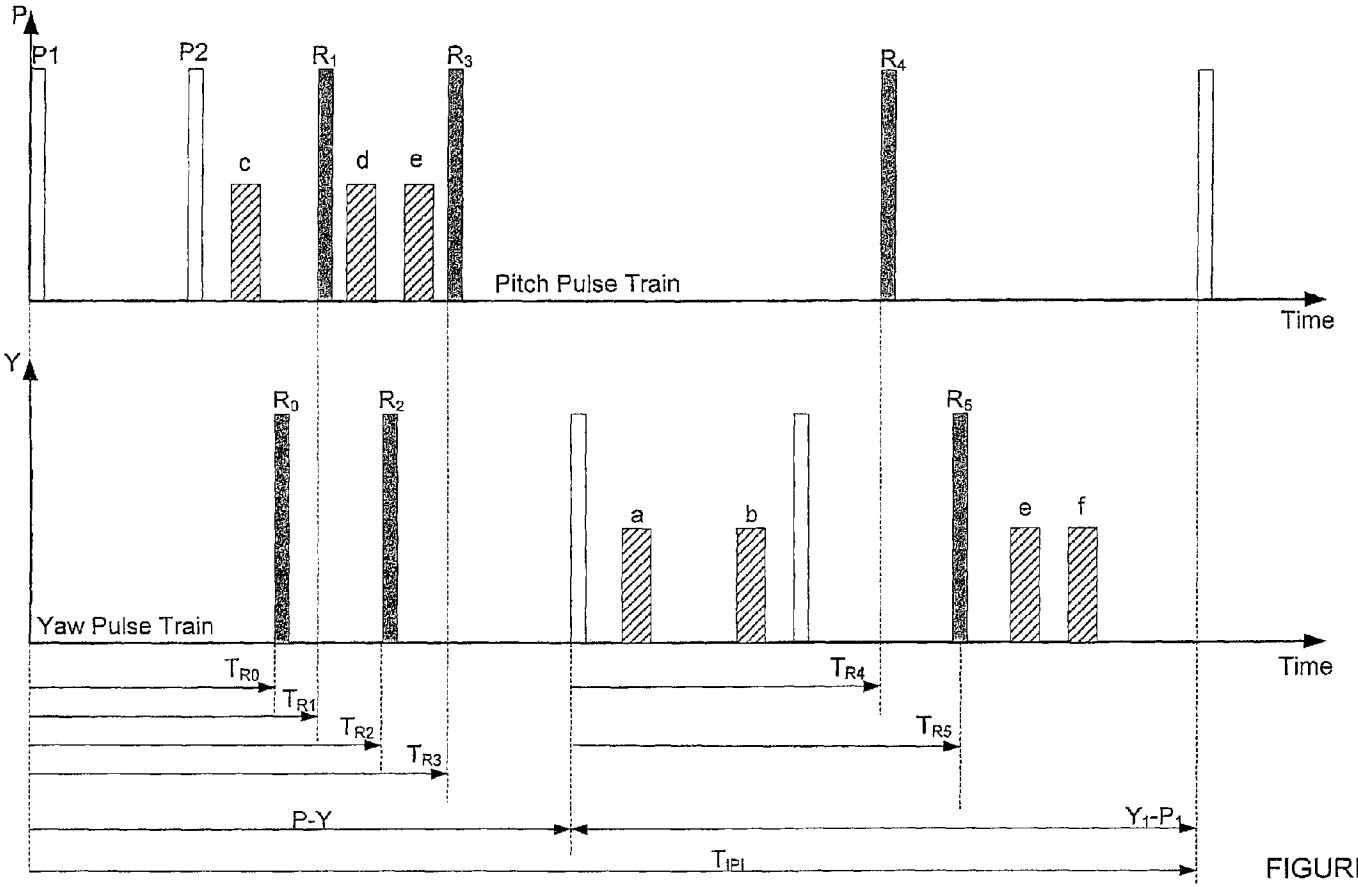
FIG. 4 is a timing diagram of pulses emitted by the generator in pursuit of emission of the laser guidance beam of FIG. 2, in accordance with an embodiment of the invention.

FIG. 4 shows the same arrangement of pulses as in FIG. 3, with the additional imposition of roll information pulses. These are in positions, taking further account of the need not to exceed the duty cycles of the two laser diodes 22, 24.

A first roll pulse $R_0$ is positioned directly after the first pitch validation window c. If emitted, it is emitted by the yaw laser diode 24.

A second roll pulse $R_1$ is positioned directly after the first roll pulse $R_0$, and before the second pitch validation window d. If emitted, it is emitted by the pitch laser diode 22.

A third roll pulse $R_2$ is positioned directly after the second pitch validation window d and before the third pitch validation window e. If emitted, it is emitted by the yaw laser diode 24.

A fourth roll pulse $R_3$ is positioned directly after the third pitch validation window e and before the first yaw pulse Y1. If emitted, it is emitted by the pitch laser diode 22.

A fifth roll pulse $R_4$ is positioned after the second yaw pulse Y2 and before the third yaw validation window e. If emitted, it is emitted by the pitch laser diode 22.

A sixth roll pulse $R_5$ is positioned directly after the fifth roll pulse $R_4$, again before the third pitch validation window e. If emitted, it is emitted by the yaw laser diode 24.

The positions of these pulses does not interfere with the framework illustrated in FIG. 3. That is, none of the pulses coincides with the validation windows, and so no false invalidation of doublets should arise as a result of inclusion of these pulses. Thus, backwards compatibility of the arrangement of FIG. 4 with the arrangement of FIG. 3 (expected by missiles not configured for use with an embodiment of the present invention) is preserved.

These pulses are selectively emitted by the LIF generator 10, in the described and illustrated positions. The six-bit binary word $R_5R_4R_3R_2R_1R_0$ (where $R_0$ is the least significant bit) denoted by the presence or absence of the respective pulses in the emitted (and detected) pulse train convey binary encoded information to the receiver concerning roll of the launch platform on which the LIF generator 10 is mounted. That way, the receiver can make adjustments to its interpretation of the spacings, in time, between the pitch doublet pairs of P1 and P2, and between the yaw doublet pairs of Y1 and Y2, to determine its pitch and yaw on the desired trajectory.

In this embodiment, the presence of a roll pulse conveys a "1" value of the respective bit, and the absence thereof conveys a "0" value. The reader will appreciate that an arrangement in which the opposite holds true could equally be implemented.

The six-bit binary number encodes the range of roll angle which the launch platform can be expected to experience. In this embodiment, with 64 possible symbols available for use, a roll angle range of ±45° is encoded. Given that, for operational needs, resolution to 2° may be sufficient, the full range of possible roll angles can be encoded using 46 symbols. This leaves 18 unused symbols. One of these symbols will be 000000 which is reserved as it consists of the absence of all roll information pulses (which might occur for numerous operational reasons).

Thus, 17 symbols can be used for other purposes. These symbols could be used to convey other information, or operational commands, a facility not available previously. For example, symbols could be assigned to a command to change a missile parameter, to provide updated course information, fuse settings, or to order the missile to leave the missile guidance system.

The symbols could be employed as single word commands, or could equally be assembled into an instruction set comprising sequences of words.

A LIF is constructed by scanning the light emitted by the two lasers across a defined and constrained space. The laser diode emissions are scanned across, left to right and top to bottom, which forms a forward sweep, then right to left and bottom to top, which forms a backward sweep. A forward sweep and backward sweep constitute a scan cycle.

A LIF comprises a number, X, of doublets and (X−1) inter pulse intervals (IPI). A doublet is formed by two laser pulses, such as P1 and P2 for pitch, as per the above example. An IPI is the spacing between two doublets.

Thus, FIGS. 3 and 4 illustrate, for each diode, a time interval commensurate with a doublet projection and an IPI.

The present embodiment implements a requirement for the roll pulse information to be consistent over the full extent of two sweeps, thus over a full scan back and forth. Thus, redundancy will be imparted, which can be used to error check the roll pulse information. This is because noise could arise at a single roll pulse position, which would erroneously convey a "1" value where a "0" value would actually have been intended. This error could have serious consequences if left unchecked.

The present embodiment employs a bit inversion scheme. Thus, while the information conveyed in a first scan sweep may be "010101", that in the subsequent scan sweep will be "101010". The received words can then be compared, on a bitwise basis, for instance using an XOR operator. In that case, if the XOR operator detects identity of any of the bits, then an error is detected. The data will then be disregarded.

Figure 5:
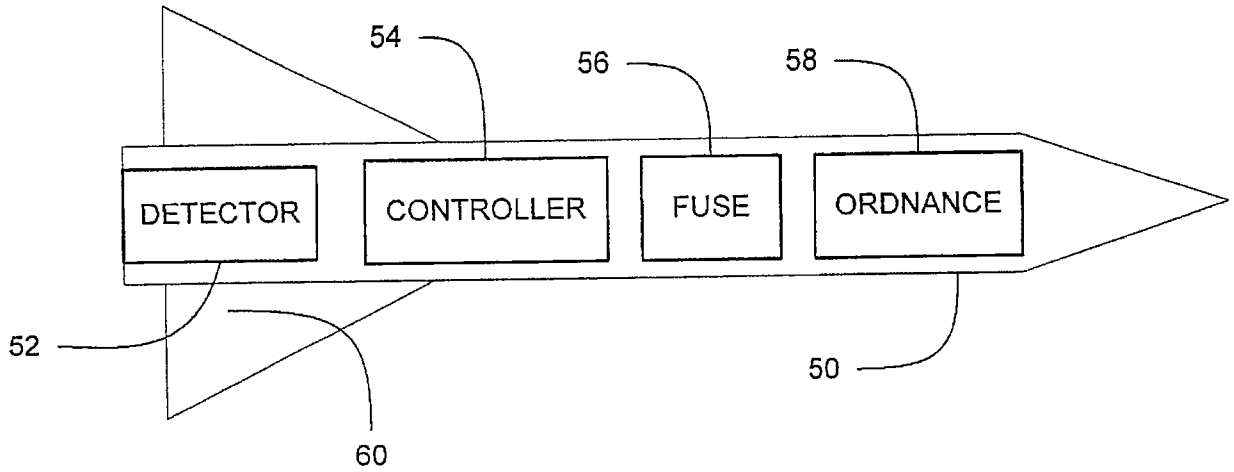
FIG. 5 is a schematic diagram of a missile for use with the embodiment illustrated in FIG. 1.
Figure 6:
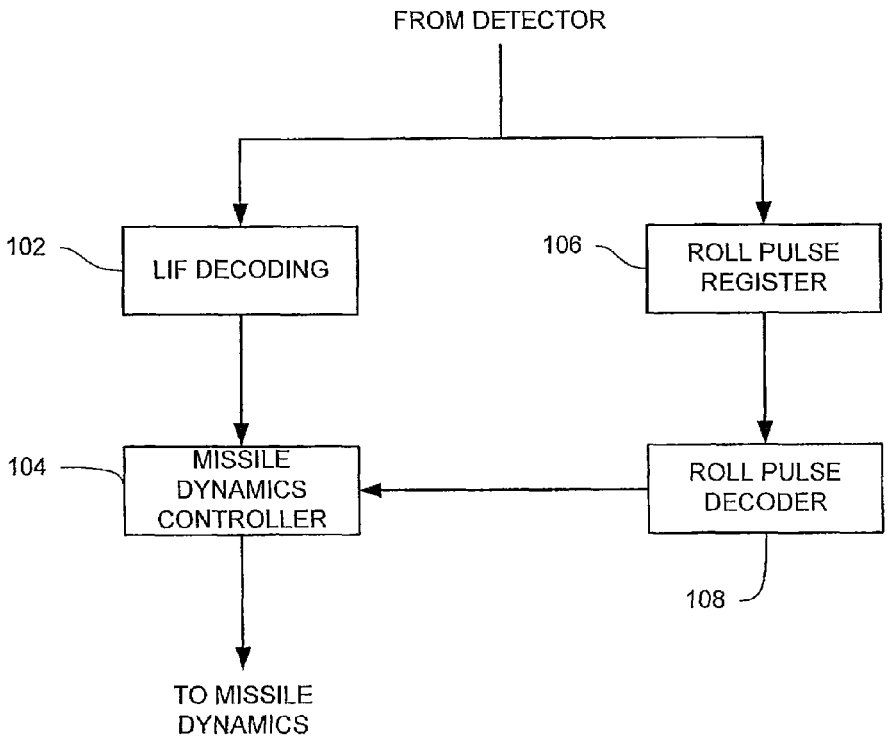
FIG. 6 is a schematic diagram of architecture of the missile of FIG. 5.

FIG. 5 illustrates a schematic diagram showing a missile for use with the above described embodiment. FIG. 6 shows a schematic diagram of a controller in that missile. As shown in FIG. 5, the missile 50 comprises a generally tubular body with a conical nose portion and a tail. In the tail, a detector 52 is positioned, operable to detect laser light of the frequency adopted by the laser diodes 22, 24. The detector passes signals corresponding to detected laser light to a controller 54, which controls attitude of canards 60 which provide aerodynamic control surfaces for use in controlling flight of the missile. A fuse 56 provides ignition of ordnance 60. The fuse 56 is under the control of the controller 54, which might have other detection means to enable ignition to be controlled relative to position, altitude, or any other external condition.

FIG. 6 shows operation of the missile. In essence, FIG. 6 shows a functional architecture of the controller 54, in response to pulses detected by the detector 52. Such pulses are fed to a LIF decoding unit 102 which decodes LIF pulses in accordance with established techniques. Roll pulses are detected and the information conveyed therein is loaded into a roll pulse register 106. The roll pulse information is passed to a roll pulse decoder 108 which acts, in accordance with the encoding scheme used to encode the roll angle, to detect whether a roll angle is stored in the conveyed information, or if, in accordance with a predefined instruction set, an instruction is being conveyed.

In response to this, relevant information is sent to a missile dynamics controller 104. This may be a compensatory signal intended to correct a roll, or to correct interpretation of the LIF data which may be distorted by roll. It may also be to override LIF control of the missile, in view of an instruction, for example, to leave the trajectory and to follow an alternative trajectory. Missile dynamics control signals are sent by the missile dynamics controller 104 to the canards 60.

Advantages associated with features of the presently described embodiment are numerous. In particular, the intention is that the presently described arrangement is to be compatible with existing missile communication. It is expected to impart greater robustness and reliability to the issue of missile guidance and communication, and to offer relatively high resolution guidance. Further, by using different information signalling techniques than were hitherto appreciated, it is expected that greater information capacity will ensue.

Backwards compatibility is achieved because the additional laser pulses, as previously described, are positioned in the LIF emission such that there is no interference with the position decoding, itself provided by existing LIF pulses. There is no interference with the position decoding carried out by LIF guided missiles, and so the present arrangement can be used by LIF guided missiles which have not been reconfigured by an arrangement in accordance with the described embodiment—a "legacy" system of such type would not be affected by the additional roll pulses.

The presently described embodiment takes account of the various advantages of digital technology in its implementation. This is exemplified by the encoding of the roll information in binary form. Detecting and decoding of binary information is generally straightforward and not prone to error. An error checking mechanism is employed, in the described embodiment, which provides an additional layer of robustness to the inherent advantages of digital communication. This can take account of any data corruption which might arise, for instance as the result of noise or interference. Update of roll information is aligned, in the described embodiment, with position update information, and thus a position update can be corrected by the latest received roll information.

Resolution, of a device in accordance with the described embodiment, can be relatively high, in comparison with existing devices. This is because the number of bits in the binary code determines the number of different combinations that is available. The range of roll that can be produced by a launch platform needs to be encoded into the binary code, and so the number of combinations available in the binary code will define the resolution across that range. For envisaged purposes, a resolution of 2 degrees is considered sufficient, and the proposed binary code is capable of delivering this resolution.

Besides conveying roll data to the missile, the described embodiment could also be further adapted to transmit other messages to the missile, such as a command to the missile to stay on course without further laser guidance, to change its deployment configuration such as fuse settings, to activate other on-board navigation systems, and so on. The disclosure need not be read as being limited to any particular implementation. This enables much greater control over a missile than was previously considered possible. In the above disclosure, it is envisaged that words of the binary code are fixed in length, but the reader will appreciate that words could be concatenated to represent data requiring a longer bit string. Thus, the capacity of the embodiment to convey information is not limited to the length of the word defined in the particular embodiment.

The invention claimed is:

1. A missile guidance apparatus comprising:

laser beam projection means operable to project a laser beam comprising a scanned projection of laser beam pulses, the laser beam pulses comprising, in use first laser beam pulses scanned in a first direction, substantially orthogonal to a beam projection direction, tracing grid lines in said first direction, and second laser beam pulses scanned in a second direction, substantially orthogonal to the first direction and to the beam projection direction, tracing grid lines in said second direction; and means for imposing information describing roll of a missile launch platform on the laser beam, wherein the laser beam projection means is further operable to selectively project third laser beam pulses, at positions in time interposed between said first laser beam pulses and said second laser beam pulses, so that said third laser beam pulses do not interfere with said first and second laser beam pulses, said third laser beam pulses encoding said information for use by a missile projected from said missile launch platform, said missile being capable of receiving said third laser beam pulses.

2. The apparatus in accordance with claim 1, wherein said positions of said third laser beam pulses constitute a binary word, the presence or absence of said third laser beam pulses at said positions encoding a value of said binary word.

3. The apparatus in accordance with claim 2, wherein said binary word has a value in a range of values, at least a subset of said values corresponding to possible roll positions of said missile launch platform, for imparting a roll position to said projected missile.

4. The apparatus in accordance with claim 3, wherein a further subset of said values correspond to command signals, for communication of a command signal to said projected missile.

5. The apparatus in accordance with claim 1, wherein at least one of said positions of said third laser beam pulses is interposed in said first laser beam pulses.

6. The apparatus in accordance with claim 1, wherein at least one of said positions of said third laser beam pulses is interposed in said second laser beam pulses.

7. A missile comprising:

a guidance system receptive to a laser guidance beam projected by a missile guidance apparatus, the guidance system including a receiver to detect emitted laser light pulses, and a controller to control flight of said missile, the controller being operable to detect first, second and third laser light pulses, and to determine, from said detected third laser light pulses, either emitted information concerning a roll position of said missile guidance apparatus, or a command signal communicated by way of said third laser light pulses, wherein the missile guidance apparatus includes:

laser beam projection means operable to project laser light comprising a scanned projection of the laser light pulses, the laser light pulses comprising, in use said first laser light pulses which are scanned in a first direction, substantially orthogonal to a light projection direction, tracing grid lines in said first direction, and said second laser light pulses which are scanned in a second direction, substantially orthogonal to the first direction and to the light projection direction, tracing grid lines in said second direction; and means for imposing information describing roll of a missile launch platform on the laser light, wherein the laser beam projection means is further operable to selectively project said third laser light pulses, at positions in time interposed between said first laser light pulses and said second laser light pulses, so that said third laser light pulses do not interfere with said first and second laser light pulses, said third laser light pulses encoding said roll information for use by a recipient receiver of missile projected from said missile launch platform, said missile being capable of receiving said third laser light pulses.

8. The missile in accordance with claim 7, operable to process detected first and second laser light pulses based on said roll information communicated thereto in said third laser light pulses, to correct pitch and yaw information conveyed in said first and second laser light pulses with respect to said roll information.

9. A missile guidance system comprising:

circuitry configured to project a laser beam comprising a scanned projection of laser beam pulses, the laser beam pulses comprising, in use first laser beam pulses scanned in a first direction, substantially orthogonal to a beam projection direction, tracing grid lines in said first direction, and second laser beam pulses scanned in a second direction, substantially orthogonal to the first direction and to the beam projection direction, tracing grid lines in said second direction;

impose information describing roll associated with a missile launch platform on the laser beam; and selectively project third laser beam pulses, at positions in time interposed between said first laser beam pulses and said second laser beam pulses, so that said third laser beam pulses do not interfere with said first and second laser beam pulses, said third laser beam pulses encoding said information for use by a missile projected from the missile launch platform, said projected missile being configured to receive said third laser beam pulses.

10. The system in accordance with claim 9, wherein said positions of said third laser beam pulses constitute a binary word, the presence or absence of said third laser beam pulses at said positions encoding a value of said binary word.

11. The system in accordance with claim 10, wherein said binary word has a value in a range of values, at least a subset of said values corresponding to possible roll positions of the missile launch platform, for imparting a roll position to said projected missile.

12. The system in accordance with claim 11, wherein a further subset of said values correspond to command signals, for communication of a command signal to said projected missile.

13. The system in accordance with claim 9, wherein at least one of said positions of said third laser beam pulses is interposed in said first laser beam pulses.

14. The system in accordance with claim 9, wherein at least one of said positions of said third laser beam pulses is interposed in said second laser beam pulses.

* * * * *